United States Patent [19]

Chauvier

[11] 4,317,243

[45] Mar. 2, 1982

[54] SYSTEM FOR CLEANING THE INTERIOR SURFACE AREA OF A VESSEL

[76] Inventor: Fernand L. O. J. Chauvier, 7 Caribou Rd., Selcourt, Springs, Transvaal Province, South Africa

[21] Appl. No.: 153,447

[22] Filed: May 27, 1980

Related U.S. Application Data

[63] Continuation of Ser. No. 965,862, Dec. 4, 1978, abandoned.

[51] Int. Cl.[3] ..... E04H 3/20

[52] U.S. Cl. ..... 4/490; 134/167 R; 137/238

[58] Field of Search ..... 4/490, 492, 497; 134/167 R, 160 R; 137/238, 237, 109

[56] References Cited

U.S. PATENT DOCUMENTS

| | | | |
|---|---|---|---|
| 1,541,540 | 6/1925 | Weir | 137/238 |
| 2,252,962 | 8/1941 | Carlson | 137/238 |
| 4,129,904 | 12/1978 | Pansini | 4/490 |
| 4,169,484 | 10/1979 | Bonigut et al. | 134/167 R |
| 4,228,553 | 10/1980 | Genuit | 4/490 |

FOREIGN PATENT DOCUMENTS

| | | |
|---|---|---|
| 509258 | 7/1939 | United Kingdom . |
| 657261 | 9/1951 | United Kingdom . |
| 783233 | 9/1957 | United Kingdom . |

*Primary Examiner*—Henry K. Artis

*Attorney, Agent, or Firm*—Wood, Herron & Evans

[57] ABSTRACT

This invention provides a valve by means of which a major portion of the suction flow of a swimming pool filtration system is channeled through an automatic cleaning device which cleans the floor and/or wall of a swimming pool, and a minor portion of the suction flow is drawn from the surface of the pool thereby to skim the surface. The valve has a main inlet opening connectable to the device, an outlet opening connectable to the filtration system and an auxiliary opening which is closed to some extent by a closure member to normally provide a restricted aperture through which the water drawn from the surface flows. The closure member is biassed closed by a spring located in a variable volume chamber which communicates with the interior of the valve between the auxiliary opening and the main inlet opening. When the restricted aperture is blocked by leaves or the like, the pressure in the chamber decreases, compressing the spring and allowing the closure member to open. The leaves or the like then pass through and the closure member closes again.

7 Claims, 2 Drawing Figures

SYSTEM FOR CLEANING THE INTERIOR SURFACE AREA OF A VESSEL

Figure 1:
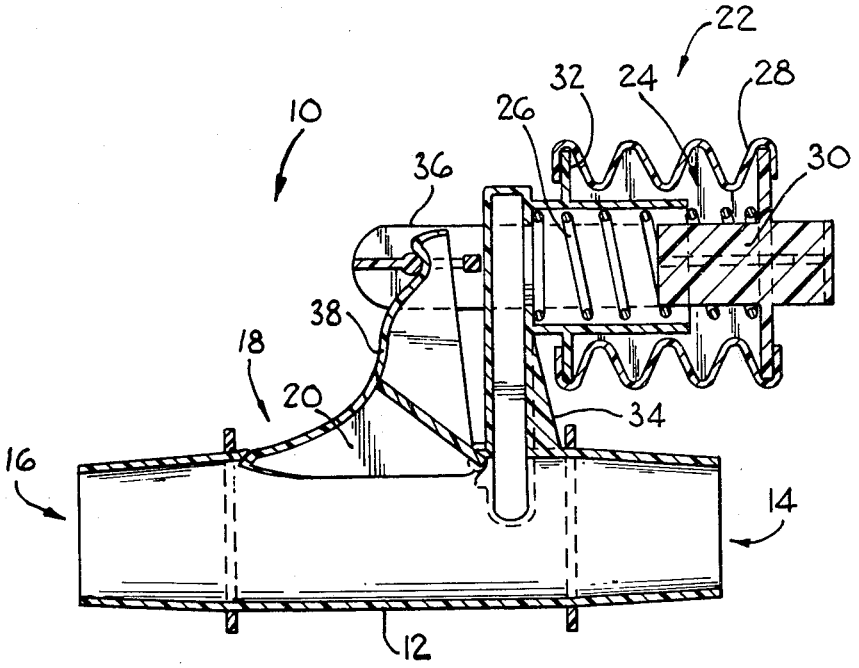

This is a continuation of application Ser. No. 965,862, filed Dec. 4, 1978, now abandoned.

This invention relates to valves. It relates in particular to valves for use in swimming pools to connect a cleaning device to a suction source.

There are presently available automatic devices for cleaning swimming pools. These devices are connected to a suction source, such as a pump, by means of a flexible hose. Further, these devices operate to clean the floor and in some cases also the walls of the swimming pools. As a result, water located at the bottom or sides of the swimming pool is sucked into the device to be subsequently filtered by a filter associated with the pump. It is however desirable that the surface water also be drawn into the filtration system, in order to skim the surface of the swimming pool.

The applicant is aware of systems in which an aperture in a cover is closed by means of a disc, the disc being biassed against the cover by means of a spring. With such systems, the biassing force is independent of the amount of water flowing through the aperture and, in use, the restricted passage provided between the cover and the disc becomes blocked with leaves and the like.

It is an object of the invention to provide a device in which a restricted aperture is opened when it becomes blocked.

According to the invention there is provided a valve for controlling the flow of a fluid, which includes

- a housing having a main inlet opening, an outlet opening connectable to a suction source, and an auxiliary opening,
- a closure means for closing the auxiliary opening, the closure means being such that when in its closed configuration a restricted aperture is provided and in its open configuration the auxiliary opening is substantially completely open; and
- a variable bias means for biassing the closure means to its closed configuration the bias means being responsive to the amount of fluid flow through the restricted aperture such that if the flow of fluid through the restricted aperture is decreased the closing bias force exerted by the bias means on the closure means is decreased.

Thus, with swimming pools and automatic cleaning devices therefor, a hose of the cleaning device may be connected to the main inlet opening. As a result, the main flow of water will be through the cleaning device, with a lesser amount of water flowing through the restricted aperture of the auxiliary opening. The valve may be so positioned that the minimal flow through the restricted aperture may be from the surface of the water, thereby skimming the surface.

However, it will be appreciated, that with such an arrangement, any articles such as leaves, paper and other detritus floating on the surface of the water, will be drawn towards the valve. As a result, it can occur that the restricted aperture may be blocked by such articles. If this happens, then the flow of fluid through the restricted aperture will decrease, the bias force will decrease, and the closure means will open, thereby allowing the article to pass into the housing to be sucked out of the valve through the outlet opening. Once the said article has passed through the auxiliary opening, there will be a substantial flow of fluid through the auxiliary opening, which will result in the bias means increasing its bias force and closing the closure means.

The closure means may conveniently be a closure member. The closure member may more specifically be in the form of a flap which is pivotally operable and which fits into the auxiliary opening. The restricted aperture may then be provided by providing sufficient clearance between the flap and the perimeter of the auxiliary opening.

Alternatively, the flap may be large enough to completely close the auxiliary opening. The flap will then, in use, pivot open a sufficient amount for there to be sufficient fluid flow for the bias means to provide an equilibrium bias force.

The bias means may be of any suitable form. It may for example be in the form of a spring.

The bias force exerted by the bias means may be varied by any suitable control means. As indicated above, the control means is responsive to the rate of fluid flow through the restricted aperture. As the rate of fluid flow will also vary the pressure of the fluid in the housing upstream from the auxiliary opening, the control means may well be responsive to pressure variations in the housing. Thus, the control means may comprise a variable volume chamber, in fluid communication with the interior of the housing. This variable volume chamber may be defined by a diaphragm, bellows, or the like, such that a portion thereof is displaced in accordance with the pressure difference between the interior and exterior of the housing. This displaceable portion may then operatively engage the bias means.

Figure 2:
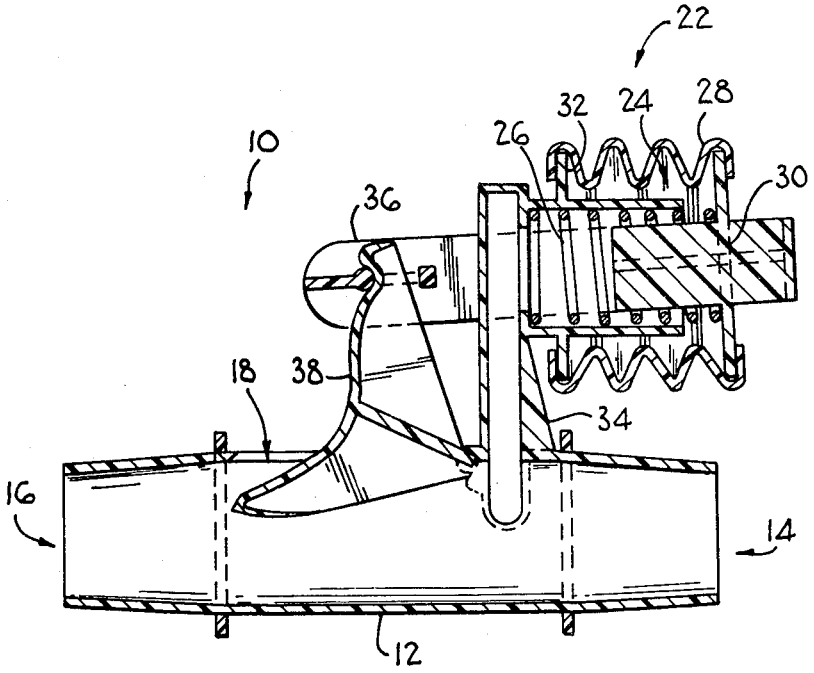

The invention is now described, by way of an example, with reference to the accompanying drawings in which:

FIG. 1 is a sectioned view of a valve in accordance with the invention, in its closed configuration; and FIG. 2 is a sectioned view of the valve in its open configuration.

Referring to the drawings, a valve in accordance with the invention is shown generally by reference numeral 10. The valve 10 is for use in swimming pools, in association with an automatic cleaning device (not shown) to which it is connected by means of a flexible hose (also not shown). As indicated earlier, the valve 10 is for channeling the main suction flow from a filtration system (also not shown) of the swimming pool, which has a suction pump, through the connecting hose, and which also provides a reduced flow of water from the surface of the swimming pool.

The valve 10 comprises a housing 12 having a main inlet opening 14, to which the connecting hose is connectable, a suction outlet opening 16 which is connectable to the filtration system, and an auxiliary opening 18 through which water drawn from the surface of the pool flows. The auxiliary opening 18 is closed by means of a flap 20. The flap 20 is pivotally mounted to be pivotal into the auxiliary opening and to close it (as shown in FIG. 1), and into the housing 12 to open the auxiliary opening 18 (as shown in FIG. 2). The flap 20 is pivoted into its closure position by means of a variable bias means 22. The variable bias means 22 is defined by a cylindrical bellows 28 which is secured at one end to a member 30 and at its other end to a flange 32 provided on an 'L'-shaped pipe 34. A chamber 24 defined by the bellows 28, communicates with the interior of the housing 12 via the pipe 34. As shown, a spring 26 is held between the pipe 34 and the member 30. The pipe 34 has a recess close to the housing 12, in which the flap 20 is pivotally seated. The member 30 has a strap 36 which engages an arm 38 of the flap 20.

In use, the valve 10 is connected between the pump of the swimming pool's filtration system and the cleaning device, and is located near the surface of the swimming pool, with the auxiliary opening 18 facing upwardly. Due to the suction force exerted by the pump, water is sucked through the cleaning device, via its connecting hose, to enter into the valve 12 via its main inlet opening 14 and to be sucked out through its outlet opening 16. With no suction applied to the valve, the spring 26 will cause the flap 20 to be pivoted into closing engagement with the housing 12. When suction is applied, flow of water through the housing 12 and past the pipe 34 will cause a lower pressure in the chamber 24 than in the water surrounding it. As a result the member 30 will be displaced, compressing the spring 26 and decreasing the force by means of which the flap 20 is held in its closed position. As a result, the flap 20 will open, allowing water to be sucked into the housing 12 through the auxiliary opening 18. This water flow will act to skim the surface. However, due to the flow of water into the housing 12 via the auxiliary opening 18 the flow in the region of the pipe 34 decreases causing the pressure inside the chamber 24 to rise slightly, thereby decreasing the pressure difference between the chamber 24 and the surrounding water. Thus, the flap 20 will reach an equilibrium position in which the auxiliary opening 18 is slightly open, thereby providing a restricted aperture.

Due to the inflow of water through this restricted aperture, the surface of the swimming pool will be skimmed. Thus, any leaves, papers and other detritus on the surface of the water will be drawn towards the valve. If such articles block the restricted aperture, then it will be clearly understood that due to the decrease in the flow of water into the housing 12 through the opening 18, the flow past the pipe 34 increases causing a decrease of pressure in the chamber 24. The member 30 will hence be displaced, compressing the spring 26 and thereby allowing the flap 20 to pivot open sufficiently far to allow the article to pass through the auxiliary opening 18 and be drawn away. Once the obstructing article has been removed, the flap 20 will be pivoted back towards its closed position, to again provide the restricted aperture.

I claim:

1. A system for cleaning an interior surface area of a vessel, as well as for simultaneously skimming the surface of liquid carried in that vessel, said system comprising a cleaning device adapted to clean said interior surface area of said vessel through use of liquid drawn therethrough, a valve connected with said cleaning device, said liquid being directed through said valve after being drawn through said cleaning device, said valve comprising a closure for an auxiliary opening that is locatable adjacent the surface of said liquid, said closure being movable between a closed position at which said auxiliary opening is closed, an intermediate open position at which said auxiliary opening is partially opened, and a full open position at which said auxiliary opening is substantially completely opened, and a variable bias device connected with said closure for inducing said closure to move toward its full open position in response to reduced fluid flow through said auxiliary opening which results from exterior blockage detritus on the surface of said liquid against said auxiliary opening, said bias device being operable to bias said closure to it closed position when there is no liquid flow through said valve, said bias device being operable to decrease the closing bias force exerted on said closure below that established when there is no fluid flow through said valve for the purpose of opening said closure to its intermediate open position when there is fluid flow without substantial exterior blockage through said valve, and said bias device being operable to decrease the closing bias force exerted on said closure below that required for opening said closure to its intermediate open position as the fluid flow through said auxiliary opening decreases in response to at leat a partial exterior blockage of said auxiliary opening, said closure thereby being moved toward said full open position in response to said exterior blockage for inducing increased fluid flow through said auxiliary opening to clear said exterior blockage from said auxiliary opening.

2. A system as set forth in claim 1, said system comprising a pump for drawing liquid through said cleaning device, and a pipe connecting said pump and said cleaning device, said valve being connected with said pipe.

3. A system as set forth in claim 2, said system comprising a filter for circulating said liquid therethrough to remove detritus from said liquid flow, and a return pipe for recirculating said liquid back into said vessel after passing said liquid through said filter.

4. A system as set forth in claim 3, said vessel comprising a swimming pool and said liquid comprising water.

5. A system as set forth in claim 1, said variable bias device comprising a spring for biassing said closure continually towards said closed position.

6. A system as set forth in claim 1, said variable bias device comprising a variable volume chamber, a vacuum being induced in said chamber in response to said liquid flow through said valve, said liquid flow through said valve being at a greater rate when said auxiliary opening is at least partially closed due to exterior blockage by detritus than when said auxiliary opening is not blocked exteriorly by detritus, and said chamber cooperating to open said closure toward said full open position when said auxiliary opening is at least partially blocked by said detritus.

7. A system as set forth in claim 6, said variable volume chamber comprising a bellows for operating said closure, one end of said bellows being fixed to said valve and the other end of said bellows being connected with said closure.

* * * * *